US011118379B2

(12) United States Patent
Barmscheidt

(10) Patent No.: US 11,118,379 B2
(45) Date of Patent: Sep. 14, 2021

(54) METHOD FOR CONTROLLING A MOTOR VEHICLE DOOR LOCK

(71) Applicant: Kiekert AG, Heiligenhaus (DE)

(72) Inventor: Christian Barmscheidt, Duisburg (DE)

(73) Assignee: Kiekert AG, Heiligenhaus (DE)

( * ) Notice: Subject to any disclaimer, the term of this patent is extended or adjusted under 35 U.S.C. 154(b) by 603 days.

(21) Appl. No.: 15/578,971

(22) PCT Filed: May 11, 2016

(86) PCT No.: PCT/DE2016/100214
§ 371 (c)(1),
(2) Date: Dec. 1, 2017

(87) PCT Pub. No.: WO2016/192708
PCT Pub. Date: Dec. 8, 2016

(65) Prior Publication Data

US 2018/0135338 A1 May 17, 2018

(30) Foreign Application Priority Data

Jun. 2, 2015 (DE) ..... 10 2015 108 739.1

(51) Int. Cl.

| | |
|---|---|
| ***E05B 77/26*** | (2014.01) |
| ***E05B 81/20*** | (2014.01) |
| ***E05B 81/66*** | (2014.01) |
| ***E05B 81/14*** | (2014.01) |
| ***E05B 81/16*** | (2014.01) |

(52) U.S. Cl.
CPC ..... *E05B 77/26* (2013.01); *E05B 81/14* (2013.01); *E05B 81/16* (2013.01); *E05B 81/20* (2013.01); *E05B 81/66* (2013.01)

(58) Field of Classification Search
CPC ..... E05B 77/26; E05B 77/265; E05B 81/20; E05B 81/66; E05B 81/14; E05B 81/16
See application file for complete search history.

(56) References Cited

U.S. PATENT DOCUMENTS 4,518,182 A * 5/1985 Cousin ..... E05B 77/26 292/201
5,516,164 A * 5/1996 Kobayashi ..... E05B 81/20 292/201

(Continued)

FOREIGN PATENT DOCUMENTS

DE 10038427 A1 * 3/2002 ..... B60R 21/01564
DE 20307347 U1 9/2004

(Continued)

OTHER PUBLICATIONS

International Search Report for corresponding Patent Application No. PCT/DE2016/100214 dated Oct. 6, 2016.

(Continued)

*Primary Examiner* — Carlos Lugo
(74) *Attorney, Agent, or Firm* — Renner, Otto, Boisselle & Sklar, LLP

(57) ABSTRACT

A method for controlling a motor vehicle door lock includes using a control unit. After actuating the inner door handle the control unit, the switch positions of the switch are queried, and depending on the position of a locking mechanism sensor, a drive is activated or deactivated.

12 Claims, 4 Drawing Sheets

(56) References Cited

U.S. PATENT DOCUMENTS 5,938,252 A * 8/1999 Uemura ..... E05B 81/14 292/201
5,992,194 A * 11/1999 Baukholt ..... E05B 47/0009 292/201
6,157,090 A * 12/2000 Vogel ..... E05B 77/26 307/10.1
6,279,361 B1 * 8/2001 Baukholt ..... E05B 81/14 292/201
6,386,599 B1 * 5/2002 Chevalier ..... E05B 81/14 292/201
6,435,600 B1 8/2002 Long
6,659,515 B2 * 12/2003 Raymond ..... E05B 81/20 292/201
6,717,290 B2 * 4/2004 Hirota ..... E05B 77/48 180/286
6,786,530 B2 * 9/2004 Fisher ..... E05B 81/14 296/146.1
6,879,058 B2 * 4/2005 Lorenz ..... E05B 77/26 292/201
6,998,969 B2 * 2/2006 Aiyama ..... E05B 77/12 180/271
7,441,815 B2 * 10/2008 Umino ..... E05B 81/06 292/201
7,642,669 B2 * 1/2010 Spurr ..... E05B 81/76 200/43.05
7,735,883 B2 * 6/2010 Inoue ..... E05B 81/20 292/201
8,025,320 B2 * 9/2011 Inoue ..... E05B 81/20 292/201
8,474,888 B2 * 7/2013 Tomaszewski ..... E05B 77/26 292/201
8,651,537 B2 * 2/2014 Imatomi ..... E05B 81/20 292/216
8,870,246 B2 * 10/2014 Itami ..... E05B 81/20 292/201
8,909,430 B2 * 12/2014 Choi ..... E05B 77/26 701/45
9,534,427 B2 * 1/2017 Menke ..... E05B 77/265
9,644,403 B2 * 5/2017 Lange ..... E05B 81/76
2003/0080569 A1 5/2003 Raymond et al.
2009/0039658 A1 * 2/2009 Spurr ..... E05B 81/00 292/336.3
2009/0151257 A1 * 6/2009 Dominique ..... E05B 81/66 49/280
2015/0048632 A1 2/2015 Menke
2015/0159407 A1 * 6/2015 Didier ..... E05B 81/20 292/197
2015/0259952 A1 * 9/2015 Barmscheidt ..... E05B 77/265 292/200
2015/0300052 A1 * 10/2015 Barmscheidt ..... E05B 79/10 292/201

FOREIGN PATENT DOCUMENTS

DE 10336602 * 3/2005
DE 202007016719 U1 4/2009
DE 202010009333 U1 10/2011
DE 20 2012 003171 U1 7/2013
DE 10 2012 003 743 A1 8/2013
DE 102015108738 A1 12/2016
GB 2 320 943 A 7/1998
JP 2001509849 A 7/2001
JP 2002129812 A 5/2002
JP 2010084321 A 4/2010
JP 2012241346 A 12/2012
WO 2013143522 A1 10/2013

OTHER PUBLICATIONS

English Translation of Notice of Reasons for Refusal dated Oct. 29, 2019 issued in counterpart Japanese Patent Application No. 2017-562986.
English Translation of Decision of Refusal dated May 26, 2020 issued in counterpart Japanese Patent Application No. 2017-562986.

* cited by examiner

State of the art

METHOD FOR CONTROLLING A MOTOR VEHICLE DOOR LOCK

FIELD OF INVENTION

The invention relates to a method for controlling a motor vehicle latch comprising a locking mechanism, an electrical drive in which the locking mechanism is unlocked by means of the electrical drive, a child safety lock device with a child safety sensor, whereby according to the switching position of the child safety sensor the electrical drive is activated or not activated and a closure drive with which the locking mechanism is transferred from a pre-ratchet position into a main ratchet position.

BACKGROUND OF INVENTION

An increasing number of functions are used in contemporary motor vehicles which facilitate operation and increase convenience. It is therefore known, for example, to use locking systems on lateral doors and/or tailgates and/or sliding doors which independently execute independent latching of the flaps or doors. To this end, the flaps or doors are closed following a closure of the door into a first ratchet position which is described as a pre-ratchet position hereafter. From this pre-ratchet position, an electrical drive usually acts on the latching system and moves the door into the final closure position which is described as a main ratchet position hereafter in relation to the motor vehicle door latch. Transfer of the door or flap into the main ratchet position is also described as closure. In addition to the pure closure of a pre-ratchet into a main ratchet, it is also known to use impulsion systems to open and/or close the lateral door. The doors are usually operated by means of a sensor and can be completely opened and closed.

In all of these latching systems, further functions can be used which increase passenger safety, for example. A known locking system for passengers is a child lock. A child lock encompasses the function that a child or person usually situated on a front seat cannot open the motor vehicle door, i.e. that even if the person in the motor vehicle attempts to alight, the internal operating lever is disabled.

In addition to the closure and safety device, latches can be equipped with electrical opening systems. Electrical opening describes the function in which the operator manually operates the internal operating lever or external door handle in which actual opening of the latch usually occurs however by means of an electrical drive. For example, an external operating lever can only operate a sensor, such as a switch, so that an electrical signal is generated, whereby the drive can be activated by means of a control unit. Alternatively, the external operating lever can be mechanically connected to an operating lever in the motor vehicle latch and accomplish a pivoting movement, for example. The operating lever can then in turn operate a switching means or a sensor which, in turn, conducts a signal to the control unit so that the drive can be activated in turn. Electrical opening thus describes an opening triggered by means of a drive, i.e. unlocking of the locking mechanism. The electrical drive can be connected to a gearbox and a drive disk which then interacts with a triggering lever and the triggering lever mechanically unlocks the locking mechanism.

A motor vehicle latch with an electrical opening mechanism is known from DE 10 2012 003 743 A1. An electrical drive consisting of a motor, a wormgear and a drive wheel can actuate a triggering lever during operation, whereby the triggering lever acts directly on the pawl and the locking mechanism comprising a catch and a pawl is unlocked. An operating lever which can be an internal operating lever or an external operating lever, for example, interacts after operation by means of the external handle or the internal door handle with a sensor which, in turn, activates the electrical drive by means of a control unit. The motor vehicle latch is in the bolted state, i.e. the latch is opened electrically without a mechanical operative connection occurring between the operating lever and the triggering lever. The operating lever and the triggering lever are mechanically disconnected by means of the bolting device. Only where emergency operation becomes necessary, for example during a power drop, the electrical drive travels into a direction opposite to the opening direction and unlocks the motor vehicle latch. In this case, an operator is then able to mechanically operate the operating lever and engage the triggering lever with the locking mechanism so that the flap, door or sliding door can be opened.

From DE 20 2012 003 171 U1, shown in FIG. 1, a further electrically opening motor vehicle latch 1 is known. In addition to electrical opening which also consists of a mechanism comprising an electromotor 3 and a drive wheel 4. This latch has a child lock 14 and a locking lever 10 having an unlocked position ER and a locked position VR. The latch is usually in the bolted state and an operating lever 5 can be operated by means of a handle, such as an internal door handle 20 or an external door handle. The operating lever 5 acts on an opening switch 19 which initializes the electrical drive by means of the control unit 16. Operating levers and triggering levers are disconnected. In the case of a lodged child lock 14, a child lock sensor 15 is activated and the control unit 16 evaluates the signal of the child lock sensor 15 during activation of an internal door handle 20. An opening switch is operated during operation of the internal operating lever by the internal door handle. If the child lock sensor is also activated, the door can thus not be opened. Mechanical and also electrical opening of the motor vehicle door latch is thus prevented.

SUMMARY OF INVENTION

Starting from the known state of the art, the task is posed to improve a known method to control a motor vehicle latch. In particular the task is set of providing the method with which the construction is to be simplified without reducing the functional scopes or allowing safety-related functions to be omitted. Furthermore, the task is set to provide a cost-effective solution of a simple construction to operate an electrically opening latch.

The task is solved according to the invention by the characteristics of the independent claim. Advantageous designs of the invention are specified in the sub-claims. It is pointed out that the exemplary embodiments described hereafter are not restrictive; instead, any possible variations are possible of the characteristics described in the description and the sub-claims and the Figures.

The task of the invention is solved in that the method for controlling a motor vehicle latch is provided comprising a locking mechanism, an electrical drive in which the locking mechanism is unlocked by means of the electrical drive, a child safety lock device with a child safety sensor, whereby according to the switching position of the child safety sensor the electrical drive is activated or not activated and a closure drive with which the locking mechanism is transferred from a pre-ratchet position into a main ratchet position, whereby a locking mechanism sensor is assigned to the locking mechanism and that according to the switching position of the locking mechanism sensor, the drive is activated or unactivatable. By using the locking mechanism sensor, the possibility is now created of providing a motor vehicle door latch in which the same functions are provided with a lower number of components without forfeiting safety features. By means of the locking mechanism sensor, a statement can directly be made as to whether the locking mechanism is in a closure position or an opening position. According to the position of the locking mechanism the locking mechanism sensor can be evaluated and provide a signal for a control unit which can execute activation or deactivation of the electrical drive. In particular, the closure position of the door, flap or sliding door can be determined by means of the locking mechanism sensor so that activation of the drive for opening is enabled.

If a motor vehicle latch is spoken of within the scope of the invention, such latching systems are meant which keep flaps, doors and/or sliding doors, components of the motor vehicle, in their closed position. Such motor vehicle latches encompass a locking mechanism comprising a catch and a pawl.

The locking mechanism can also be equipped with two or more pawls or have a ratchet or blocking lever, for example. Such locking mechanisms are known from the state of the art. Furthermore, the motor vehicle latch according to the invention has an electrical drive which can unlock the locking mechanism. The electrical drive usually operates indirectly but can also operate directly on a triggering lever which then mechanically engages into the locking mechanism and unlocks.

The electrical drive can encompass an electromotor, a wormgear and an output gear, whereby the output gear operates directly on the triggering lever. According to the invention, a child safety device is also provided for which encompasses a child safety sensor. The child safety sensor can be equipped as a switching element or also as a contact-sensitive sensor. According to the switching position of the child safety sensor, a signal is transmitted to a control unit which then in turn activates or does not activate the electrical drive.

The motor vehicle latch according to the invention also has a closure drive. A locking mechanism can be transferred from a pre-ratchet position into a main ratchet position by means of a closure drive. A pre-ratchet position is the position of the door, flap or hood in which the door is already closed and is held in position by means of the locking mechanism and in particular in a ratchet position. The motor vehicle door is then transferred from the pre-ratchet position into the main ratchet position by means of a usually electrical drive in which the door is located in the completely closed position.

If the child safety device is switched on or inserted and if the motor vehicle latch is transferred from the pre-ratchet into the main ratchet position by means of the closure drive, the door should be opened by means of the internal operating lever. The child safety device must be disabled for this purpose. The disablement can occur, for example, by means of an electrical drive. According to the object of the invention, an electrical drive can be dispensed with to configure the child safety device. A further signal is available by means of the inclusion of the locking mechanism sensor with which a statement is possible regarding the closure position of the door. By the inclusion of the locking mechanism sensor activation of the electrical drive can occur to open the door by means of the control unit during an operation of the internal operating lever. A mechanical configuration of the child safety device is thus not necessary.

In one embodiment of the invention, the position of the locking mechanism in the pre-ratchet and the main ratchet is detectable by means of the locking mechanism sensor If the direct position of the locking mechanism in the pre-ratchet and the main ratchet is detectable by means of the locking mechanism sensor, a control unit can bypass the child safety sensor signal and thus give an operator of the internal operating lever the possibility to open the door or to interrupt a closure process and to interrupt closure. By means of the detection of the position of the locking mechanism in a position between the pre-ratchet and main ratchet the operator of the internal operating lever located in the vehicle can give the possibility of also opening an as not yet completely closed side door even when the child safety device is engaged. This offers a high degree of safety and simultaneously guarantees that the child safety device in fully available in its function when the door is closed.

Advantageously, the locking mechanism sensor can be arranged on the catch in a further embodiment of the invention. A direct query of the position of the catch entails a high degree of safety. If the catch is located in its end position, i.e. in the position in which the door is completely closed and if exactly this position is queried by means of the locking mechanism sensor, malfunctions can thus be prevented with the greatest possible certainty.

If an operating lever is provided for and if at least an opening switch can be operated by means of the operating lever, a further embodiment of the invention thus results. An operating lever can be an internal operating lever and also an external operating lever. The operating lever is operated by means of an internal door handle or an external door handle, whereby in the unbolted state the operating lever moves the triggering lever so that the locking mechanism can be unlocked. Advantageously, the operating lever interacts with an opening switch. The internal operating lever and also the external operating lever preferably operate a common opening switch. A further switch upstream from the opening switch can be provided for with which the operating lever comes into contact before reaching the opening switch and which serves to activate the control unit This further upstream switch can thus be described as a wake-up switch. Advantageously thus an internal operating lever and an external operating lever are provided for and with the internal operating lever and the external operating lever at least the opening switch can be operated.

A further advantageous embodiment results when a coupling lever is provided for and if, by means of the coupling lever, the operating lever can be coupled with a triggering lever. The provision of a coupling lever enables the operating lever to be coupled with the triggering lever by a movement of the coupling lever which, for example, can be a pushing movement or a rotational movement or a pivoting movement. The coupling lever can preferably be operated with an electrical drive. The coupling lever can have an operating pin which, for example, engages into grooves of the triggering lever and the operating lever and thus couples the pivotably accommodated levers.

If a bolting lever is provided for and if the coupling lever is movable by means of the bolting lever so that the operating lever can be coupled, a further embodiment of the invention thus results. The operating lever is formed as a pivotably accommodated lever. The internal operating lever, the external operating lever and the triggering lever are preferably accommodated on a common axis. The coupling lever can engage the internal operating lever and/or the external operating lever with the triggering lever by means of a pushing movement according to the position of the coupling lever. The coupling lever is moved by means of an also pivotably accommodated bolting lever. In a first position of the coupling lever the internal operating lever and the external operating lever are coupled with the triggering lever, i.e. mechanically engaged. In this position the external operating lever can be moved by an operation of an external door handle, for example, and the locking mechanism is mechanically and electrically unlocked and the motor vehicle door is thus opened.

In a second position of the coupling lever the external operating lever is disengaged with the triggering lever. In this position, the bolt can be raised by operation of the internal door handle and thus the internal operating lever so that the coupling lever is returned to its original position and the latch can be opened again by means of the external operating lever. In a further third position of the coupling lever neither the external operating lever nor the internal operating lever is engaged with the triggering lever, whereby additionally the internal door handle is disengaged from the engagement in the bolting device. Disengaged hereby means that the bolting cannot be raised even with operation of the internal door handle. This position of the coupling lever is reached by the child safety device. The operating lever can be moved and operates the opening switch. However, a mechanical unbolting of the coupling lever is not possible in this position.

If the child safety device interacts with the coupling lever so that the internal operating lever can be uncoupled by means of the child safety device, a further advantageous embodiment of the invention thus results. By means of the engagement of the child safety device into the coupling lever a structurally beneficial solution is enabled to attain the child safety function. The child safety device preferably consists of a pivotably accommodated child safety element which can preferably be operated externally by the operator by means of a tool, such as a motor vehicle key or a screwdriver.

A child safety sensor interacts with the child safety element which, according to the position of the child safety element, transfers a signal to the control unit so that it is detectable whether the child safety device is activated or deactivated. The child safety device preferably comprises the child safety sensor, the child safety element pivotably accommodated in the motor vehicle door latch and a towing arm which, on the one hand, engages with the child safety element and on the other hand with the coupling lever and/or the bolting lever.

In preferred embodiments the internal operating lever and the external operating lever are accommodated coaxially. Furthermore, the internal operating lever and the external operating lever i.e. the operating lever are also accommodated coaxially with the triggering lever.

In an alternative embodiment a control unit is provided for, whereby by means of the control unit the switching positions of the switch can be queried so that the drive can be activated or deactivated. By means of the control unit the different settings are detectable on the motor vehicle latch and the drives can be activated. Thus, the switching position of the sensors and switches is queried by means of the control unit and relevant control signals are conducted to the drive(s). If, for example, the external operating lever operates by means of the external door handle, the external operating lever thus oscillates and activates the wake-up switch and as a follow-up the opening switch. The control unit thus detects a signal with which the drive can be activated so that the motor vehicle door latch can be unlocked and the door, flap or sliding door can be opened.

BRIEF DESCRIPTION OF DRAWINGS

Hereinafter the invention is explained in further detail with reference to the attached drawings and flow diagrams on the basis of a preferred embodiment. However, the principle applies that the preferred embodiment does not restrict the invention but only constitutes an advantageous embodiment. The characteristics depicted can be executed individually or in combination, individually or in combination with other characteristics of the description, as also the patent claims.

The following are shown.

DETAILED DESCRIPTION OF DRAWINGS

Figure 1:
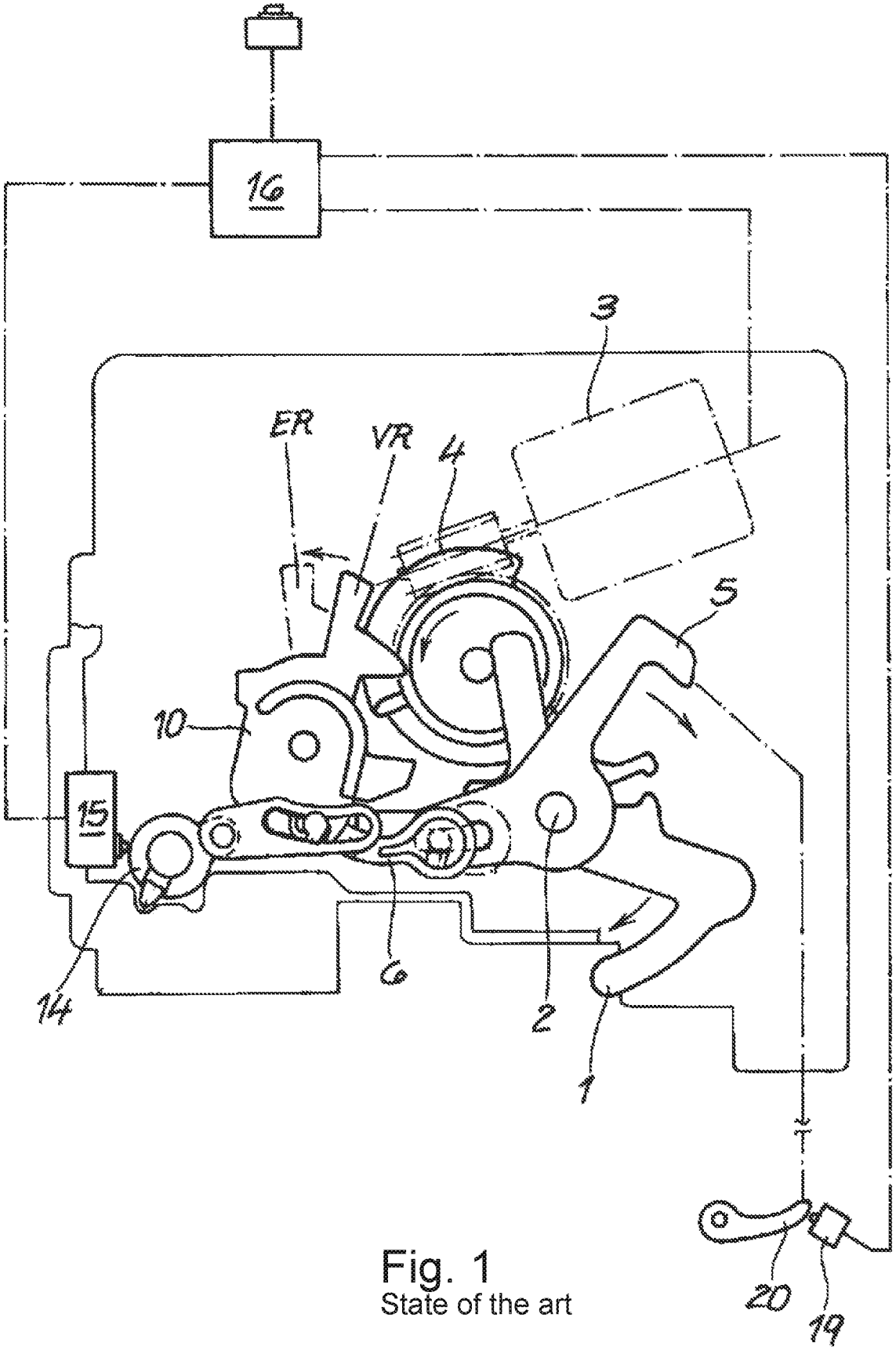
FIG. 1 an electrically operable motor vehicle latch according to the state of the art, FIG. 2 the top view of an electrically operable motor vehicle lateral door latch according to an embodiment of the invention, FIG. 3 a method in the form of a flow diagram to illustrate operation of an internal operating lever in a motor vehicle side door latch according to the state of the art and FIG. 4 a method in the form of a flow diagram to open a side door by means of an internal operating lever for the electrical opening of the door according to the invention.

In FIG. 1 a class-specific motor vehicle latch is reproduced according to the state of the art. A triggering lever 1 is pivotably accommodated around an axis 2. The triggering lever 1 is impelled by an electromotor 3 and a drive wheel 4 in the direction of the arrow so that a locking mechanism can be unlocked. An operating lever 5 is also pivotably accommodated around the axis 2 coaxially with the triggering lever 1. The operating lever 5 can be coupled with the bolting lever 10 by means of the coupling lever 6. The coupling lever 6 also interacts with the child safety element 14.

If the motor vehicle latch is now bolted and the child safety device engaged, an occupant of the motor vehicle cannot unbolt the latch in the closed state and thus cannot open the door. In particular in the case in which the motor vehicle latch has a closure drive, the motor vehicle door should be able to be opened during electrical closure by means of the internal door handle or the internal operating lever. The child safety device must be configured for this purpose. A configuration can occur temporarily, for example, by means of an electromotor not illustrated in FIG. 1 and directly acting on the child safety element.

Figure 2:
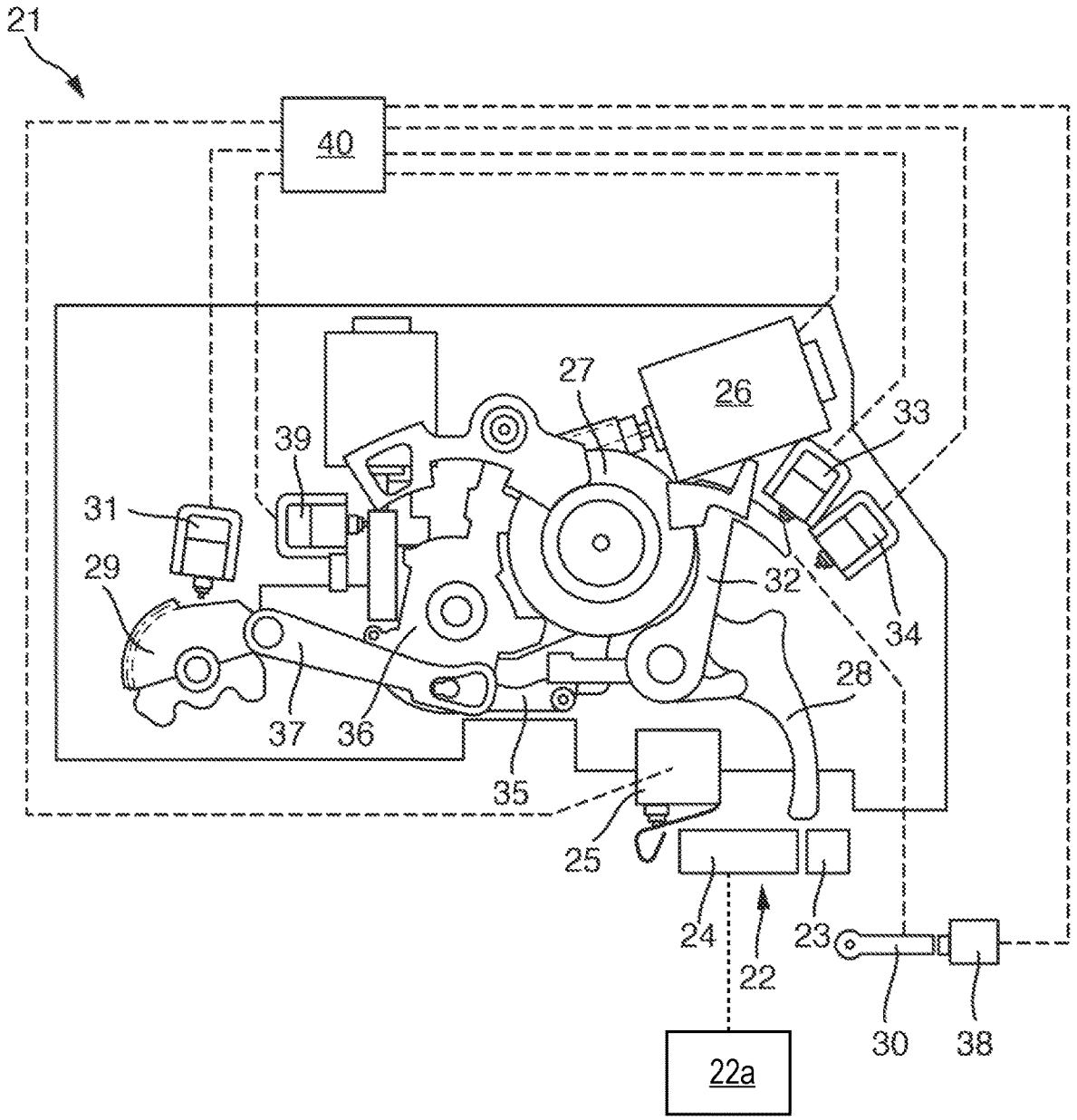

In FIG. 2, a motor vehicle door latch 21 according to the invention is reproduced in principle. The motor vehicle door latch 21 has a locking mechanism 22 consisting of a pawl 23 and a catch 24. A locking mechanism sensor 25 interacts directly with the catch 24. As can be recognized, the position of the catch 24 is queried or detected by means of the locking mechanism sensor 25 directly. A triggering lever 28 can be operated by means of an electrical drive 26 and a drive wheel 27. The triggering lever is thus able to unlock the locking mechanism 22. By means of a child safety device 29 the motor vehicle latch 21 can be disabled by means of an internal door handle 30 in such a way that the locking mechanism cannot be unlocked. Whether the child safety device 29 is engaged or not, i.e. activated or deactivated, can be recorded by the child safety sensor 31.

A closure drive 22*a* acts directly on the locking mechanism 22, in particular on the catch 24, and is able to transfer the locking mechanism 22 from a pre-ratchet position into a main ratchet position. In the main ratchet position of the locking mechanism 22 the catch 24 activates the locking mechanism sensor 25.

By means of an operating lever 32 a first wake-up switch 33 and an opening switch 34 can be operated. The operating lever 32 can be coupled with the bolting lever 36 by means of a coupling lever 35. A towing arm 37 acts between the child safety device 29 and on the bolting device 36 and the coupling lever 35. The switching elements 25, 31, 33, 34, 38 and 39 contained in the motor vehicle latch 21 are connected to a control unit 40, as depicted with the dot-dashed lines. The interplay or the integration of the switching means 25, 31, 33, 34, 38 and 39 during operation of the internal operating lever 30 during closure in cooperation with the control unit 40 is reproduced in the following flow diagrams.

Figure 3:
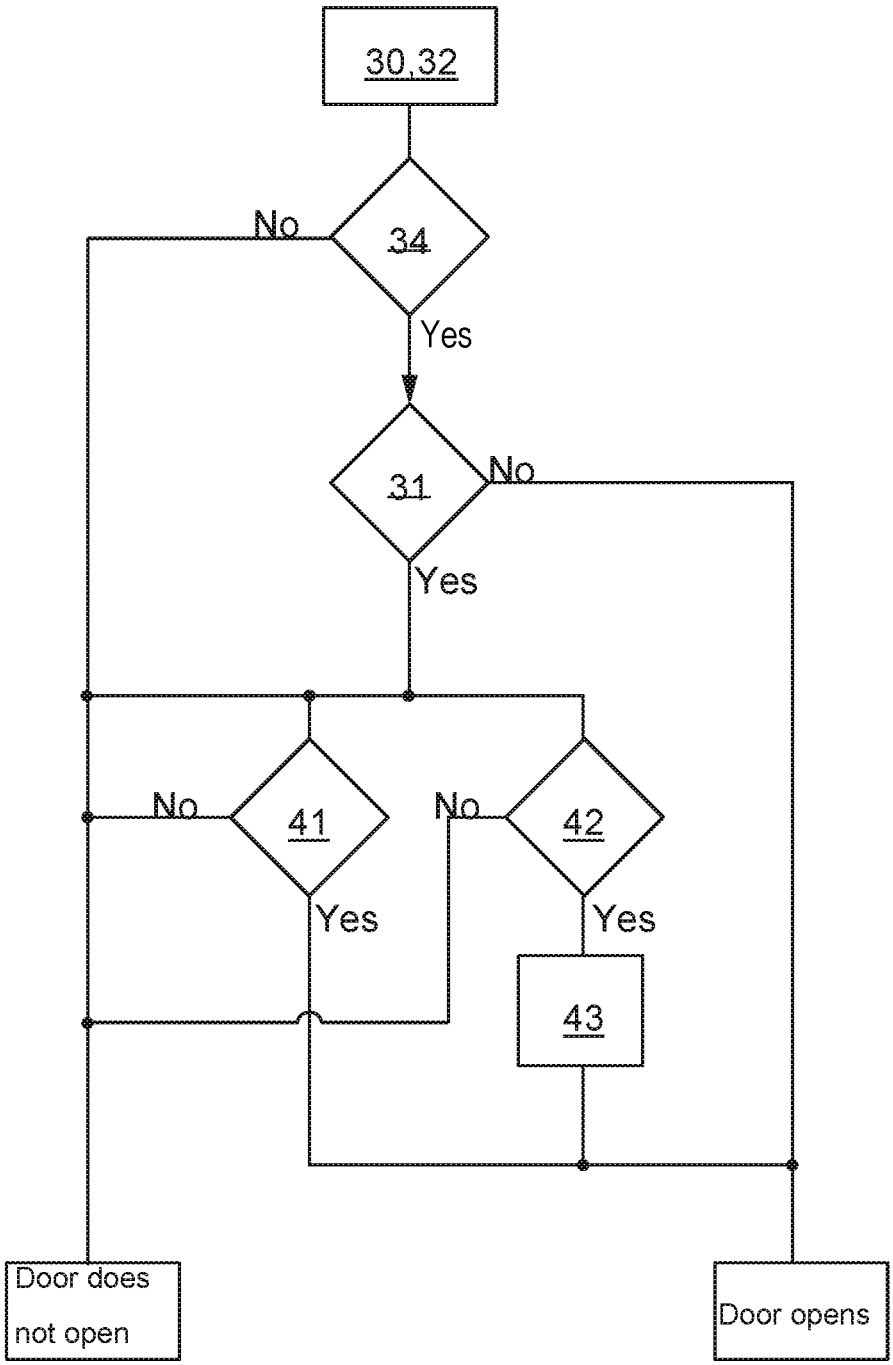
Fig. 3 PRIOR ART

FIG. 3 shows a flow diagram to open a side door and in particular a rear side door, in an operation of the internal door handle 30 and thus the operating lever 32.

If the internal door handle 30 and thus the operating lever 32 is moved, the opening switch 34 is thus operated. If the opening switch 34 is operated a further querying occurs in respect of whether the child safety sensor 31 is activated or deactivated. If the child safety switch is activated and thus the child safety device is engaged, a first query occurs as to whether by means of a release switch 41 the child safety device 29 was temporarily switched off. A temporary switch-off of the child safety sensor can occur by the driver of the vehicle, for example.

If the release switch 41 was operated, the door can thus be opened which can be found in the flow diagram in the lower right box. If a closure process 42 occurs after querying the child safety sensor 31 the door should be able to be opened by means of the internal door handle 30. The child safety device 29 therefore needs to be configured mechanically. The mechanical configuration, for example, with an electrical drive is reproduced with the box 43 in the flow diagram. The door can then be opened. As an example, it is referred to that according to the query of the closure 42 the door can then not be opened by means of the internal door handle 30 if the closure process is not activated. FIG. 3 thus shows that a mechanical drive is required for the child safety device 29 to open the door by means of the internal door handle 30 during closure.

Figure 4:
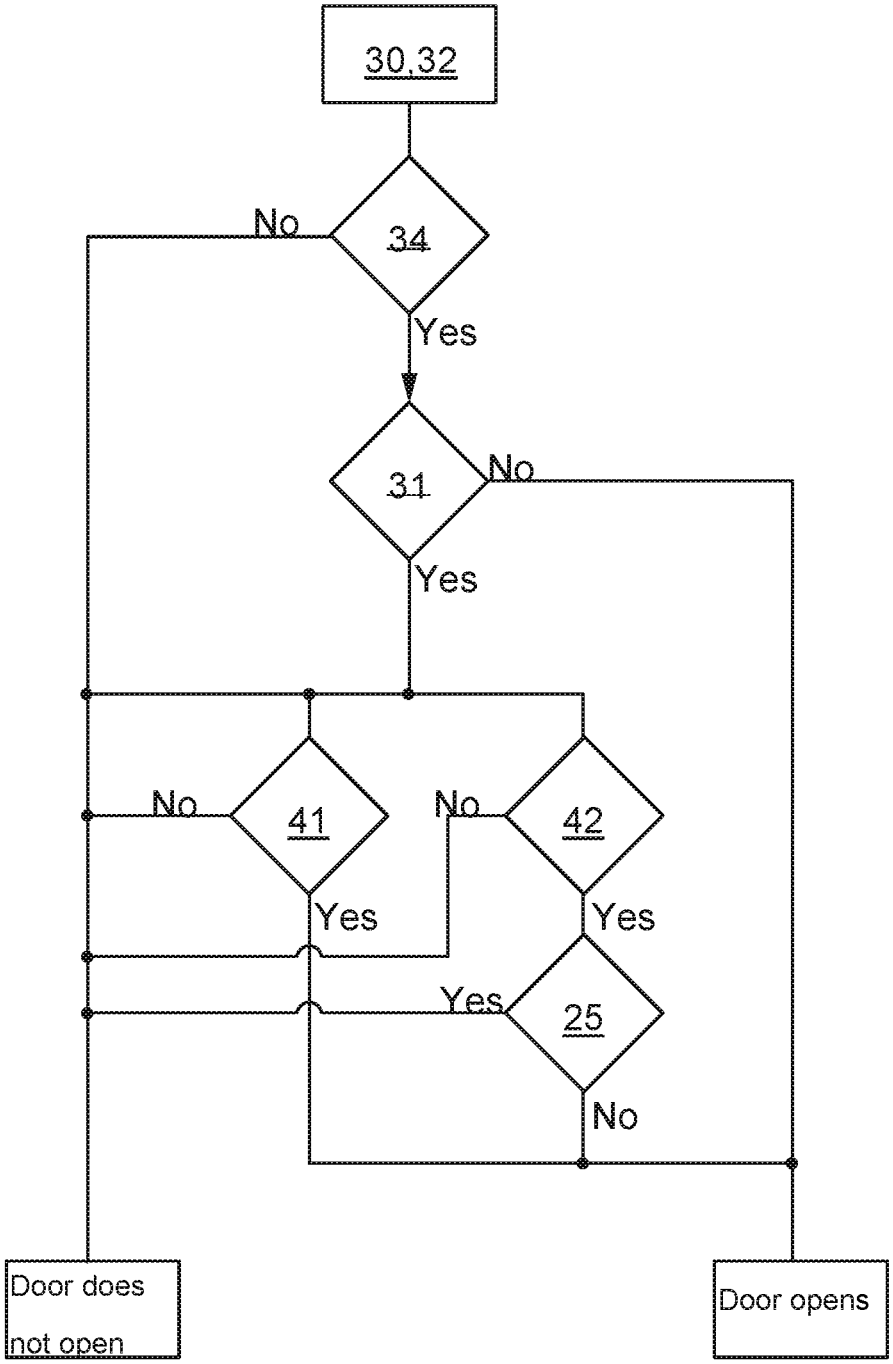

FIG. 4 shows a method for controlling an opening of a motor vehicle door by means of an internal door handle (30) in a flow diagram in which the locking mechanism sensor is incorporated into the query for controlling the operating lever 32 during closure of the locking mechanism 22. After operation of the internal door handle 30 and thus the operating lever 32 activation of the opening switch takes place initially and the query as to whether the opening switch 34 was operated or not. If the opening switch 34 was operated, the control queries whether the child safety sensor 31 was activated or is deactivated.

If the child safety catch is engaged, two alternative routes are possible. On the one hand, the release switch 41 can have been operated so that the door can be opened. And, on the other hand, a query occurs as to whether the closure 42 lasts or is not activated. If the closure 42 is in progress, i.e. the locking mechanism is usually locked in an electrically operated manner thus a further query of the locking mechanism sensor 25 thus occurs as to whether the locking mechanism 22 is already completely locked, i.e. is located in the main ratchet. If the locking mechanism 22 is not yet in the main ratchet position, the closure 42 continues and the door can be opened by means of the internal door handle 30 or the operating lever 32. Thus, according to the invention mechanical configuration of the child safety device 29 can be dispensed with. The electrical drive for the child safety device 29 can thus cease to apply.

LIST OF REFERENCE SYMBOLS

1 Triggering lever
2 Axis
3 Electromotor
4 Drive pulley
5 Operating lever
6 Coupling lever
10 Locking lever
14 Child safety element
21 Motor vehicle latch
22 Locking mechanism
23 Pawl
24 Catch
25 Locking mechanism sensor
26 Electrical drive
27 Drive disk
28 Triggering lever
29 Child safety device
30 Internal door handle
31 Child safety sensor
32 Operating lever
33 Wake-up switch
34 Opening switch
35 Coupling lever
36 Locking lever
37 Tappet
38,39 Sensor
40 Control unit
41 Release switch
42 Closure device
43 Electrical configuration of the child safety device

The invention claimed is:

1. A method for controlling a motor vehicle latch comprising a locking mechanism, an electrical drive configured to unlock the locking mechanism, a child safety lock device with a child safety sensor, a closure drive configured to transfer the locking mechanism from a pre-ratchet position into a main ratchet position during a closure process of the closure drive, a locking mechanism sensor corresponding to the locking mechanism, an operating lever, and a control unit configured to query the child safety sensor, the closure drive, and the locking mechanism sensor, the method comprising:

operating an opening switch using the operating lever;

querying the opening switch using the control unit to determine whether the opening switch is activated;

querying the child safety sensor if the opening switch is determined to be activated, wherein the child safety sensor is queried to determine whether the child safety lock device is engaged, and wherein the motor vehicle door cannot be opened if the opening switch is determined to not be activated;

querying the closure drive if the child safety lock device is determined to be engaged, wherein the closure drive is queried to determine whether the closure drive is activated;

querying the locking mechanism sensor to determine whether the locking mechanism is in the main ratchet position if the closure drive is determined to be activated, and wherein the motor vehicle door cannot be opened if the closure drive is determined to not be activated; and opening a motor vehicle door with the operating lever if the locking mechanism is determined to be in the pre-ratchet position prior to reaching the main ratchet position thereby bypassing the engaged child safety lock device to interrupt the closure process of the closure drive, wherein the motor vehicle door cannot be opened if the locking mechanism is determined to be in the main ratchet position.

2. The method for controlling a motor vehicle latch according to claim 1 further comprising detecting whether the locking mechanism is in the pre-ratchet or the main ratchet using the locking mechanism sensor.

3. The method for controlling a motor vehicle latch according to claim 1 further comprising detecting a position of a catch of the locking mechanism using the locking mechanism sensor.

4. The method for controlling a motor vehicle latch according to claim 1 further comprising operating a coupling lever with the electrical drive, wherein the coupling lever couples the operating lever and a triggering lever.

5. The method for controlling a motor vehicle latch according to claim 4 further comprising engaging the child safety device with the coupling lever, whereby the child safety device is uncoupled from the operating lever.

6. The method for controlling a motor vehicle latch according to claim 1 further comprising opening the door if the child safety lock is disengaged.

7. The method for controlling a motor vehicle latch according to claim 1 further comprising operating an internal door handle engageable with the operating lever.

8. A motor vehicle latch comprising:

a locking mechanism;

an electrical drive configured to unlock the locking mechanism;

a child safety lock device with a child safety sensor;

a closure drive configured to transfer the locking mechanism from a pre-ratchet position into a main ratchet position during a closure process of the closure drive;

a locking mechanism sensor corresponding to the locking mechanism;

an opening switch;

an operating lever that is activated to operate the opening switch; and a control unit configured to:

query the opening switch to determine whether the opening switch is activated;

query the child safety sensor if the opening switch is determined to be activated, wherein the child safety sensor is queried to determine whether the child safety lock device is engaged, wherein the motor vehicle door cannot be opened if the opening switch is determined to not be activated;

query the closure drive if the child safety lock device is determined to be engaged, wherein the closure drive is queried to determine whether the closure drive is activated;

query the locking mechanism sensor to determine whether the locking mechanism is in the main ratchet position if the closure drive is determined to be activated, wherein the motor vehicle door cannot be opened if the closure drive is determined to not be activated; and open a motor vehicle door with the operating lever if the locking mechanism is determined to be in the pre-ratchet position prior to reaching the main ratchet position thereby bypassing the engaged child safety lock device to interrupt the closure process of the closure drive, wherein the motor vehicle door cannot be opened if the locking mechanism is determined to be in the main ratchet position.

9. The motor vehicle latch according to claim 8, wherein the locking mechanism includes a catch and the locking mechanism sensor is arranged to detect a position of the catch.

10. The motor vehicle latch according to claim 8 further comprising a triggering lever and a coupling lever operable by the electrical drive, wherein the coupling lever couples the operating lever and the triggering lever.

11. The motor vehicle latch according to claim 10, wherein the coupling lever is engageable with the child safety device whereby the child safety device is uncoupled from the operating lever.

12. The motor vehicle latch according to claim 8 further comprising an internal door handle engageable with the operating lever.

* * * * *